US005829059A

United States Patent [19]

Covington, Jr.

[11] Patent Number: 5,829,059

[45] Date of Patent: Nov. 3, 1998

[54] COVERALLS WITH ACCESS OPENING

[76] Inventor: Daniel M. Covington, Jr., Box 841, Springhill, La. 71075

[21] Appl. No.: 888,670

[22] Filed: Jul. 7, 1997

[51] Int. Cl.[6] ..... A41D 1/06

[52] U.S. Cl. ..... 2/79; 2/69

[58] Field of Search ..... 2/70, 79, 83, 114, 2/69, 227

[56] References Cited

U.S. PATENT DOCUMENTS

| | | | |
|---|---|---|---|
| 302,901 | 8/1884 | Fenne . | |
| 676,158 | 6/1901 | St. John . | |
| 788,198 | 4/1905 | Ferger . | |
| 1,386,950 | 8/1921 | Rifkin . | |
| 4,570,268 | 2/1986 | Freeman | 2/114 |
| 5,097,535 | 3/1992 | Dye et al. | 2/114 X |
| 5,097,536 | 3/1992 | Cohen | 2/114 |
| 5,331,685 | 7/1994 | Belgrad | 2/79 |
| 5,621,917 | 4/1997 | Howsden | 2/114 X |

*Primary Examiner*—Michael A. Neas
*Assistant Examiner*—Shirra L. Jenkins
*Attorney, Agent, or Firm*—John M. Harrison

[57] ABSTRACT

Coveralls having a reversibly closable access opening partially dividing the front of the coveralls across the chest and arm or arms, to facilitate easy ingress and egress of the coveralls. In a first embodiment the access opening is reversibly closed by a zipper and extends from the central vertical opening dividing the front of the coveralls, across one side of the chest and down one sleeve of the coveralls. Ingress of the coveralls is facilitated by opening the front opening and the access opening, stepping into the legs of the coveralls and then closing the front opening and access opening, whereas egress is facilitated by opening the front opening and access opening and then stepping out of the coveralls. In another embodiment a second access opening extends from the front opening of the coveralls, across the opposite side of the chest from the first access opening and extends down the opposite sleeve of the coveralls. In other embodiments the access opening is reversibly closed by means of alternative closures such as a loop-pile fastener, buttons, or snaps.

4 Claims, 2 Drawing Sheets

1/2

COVERALLS WITH ACCESS OPENING

BACKGROUND OF THE INVENTION

Field of the Invention

This invention relates to coveralls and more particularly, to coveralls provided with at least one closable access opening which partially divides the front of the coveralls to facilitate easy ingress and egress of the coveralls. In a preferred embodiment the coveralls include a standard, typically zippered front opening which extends vertically from the collar to the fly of the coveralls and a zippered access-opening extends from the front opening beneath the collar, across the chest and down one sleeve of the coveralls. Easy ingress of the coveralls is facilitated by unzipping the front opening and access opening, stepping into the legs of the coveralls and then closing the front opening and access opening, whereas egress of the coveralls is facilitated by unzipping the access opening and front opening and then stepping out of the legs of the coveralls. In another embodiment a second access opening extends from the front opening of the coveralls opposite the first access opening and down the opposite sleeve of the coveralls. In still another embodiment the access opening or openings are reversibly closed by means of alternative closures such as loop and pile fastener strips provided along the respective edges of the access opening or openings, or buttons or snaps.

Conventional coveralls are frequently worn by workers over, or in lieu of regular clothing, in order to protect the clothing or person and to keep the worker warm when working under cold conditions. However, putting on and removing the coveralls is frequently cumbersome, since the only access opening is the vertical front opening, which typically extends from the collar to the fly of the coveralls and the worker usually encounters difficulty in extending his or her arms down the sleeves after stepping into the legs of the coveralls. Likewise, lack of additional access openings hinders removal of the coveralls, since removing the arms from the sleeves is difficult.

Accordingly, an object of this invention is to provide coveralls provided with at least one auxiliary access opening which extends from the conventional vertical front opening of the coveralls, across the chest and down a sleeve of the coveralls to facilitate easy ingress and egress of the coveralls.

Another object of this invention is to provide coveralls provided with at least one access opening which communicates with the conventional vertical front opening in the coveralls and extends from at or near the top of the front opening, across the chest and down a sleeve or sleeves of the coveralls to facilitate easy ingress and egress of the coveralls by enabling a worker to more easily extend his or her arms down the sleeves of the coveralls when putting the coveralls on and removing his or her arms from the sleeves of the coveralls when removing the coveralls.

Still another object of this invention is to provide coveralls having a pair of auxiliary access openings, each of which extend from the conventional vertical front opening, across the chest and down the respective sleeves of the coveralls.

Yet another object of this invention is to provide coveralls provided with one or more auxiliary, across-the-chest and down-the-arm access opening which is reversibly closed by means of a zipper or alternative closure.

A further object of this invention is to provide coveralls provided with at least one auxiliary access opening which is reversibly closed by means of loop-pile fastener strips provided along the edges of the access opening.

Another object of this invention is to provide coveralls provided with at least one auxiliary access opening reversibly closed by means of buttons or snaps.

SUMMARY OF THE INVENTION

These and other objects of the invention are provided in coveralls provided with at least one access opening which extends from the conventional vertical front opening, across the chest and down at least one sleeve of the coveralls to cooperate with the vertical front opening and facilitate easy ingress and egress of the coveralls. In a preferred embodiment a first access opening extends from the vertical front opening, across the chest and down one of the sleeves of the coveralls and is reversibly sealed by means of a closure such as a zipper, loop-pile fastener strips, buttons or snaps. In another embodiment a pair of access openings extend from the front opening, across the chest in opposite directions and down the respective sleeves of the coveralls and are similarly closed.

BRIEF DESCRIPTION OF THE DRAWING

The invention will be better understood by reference to the accompanying drawings, wherein.

DESCRIPTION OF THE PREFERRED EMBODIMENTS

Figure 1:
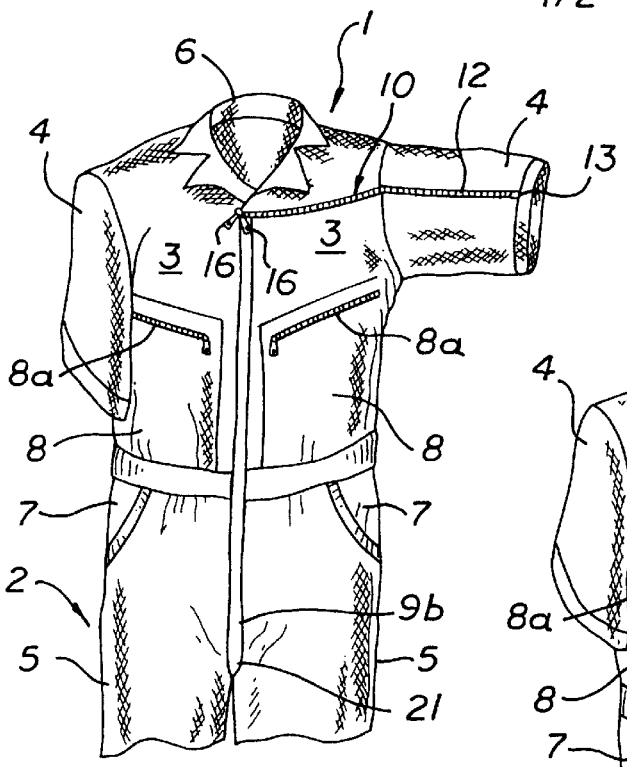
FIG. 1 is a front view of a preferred embodiment of the coveralls with access opening of this invention.
Figure 2:
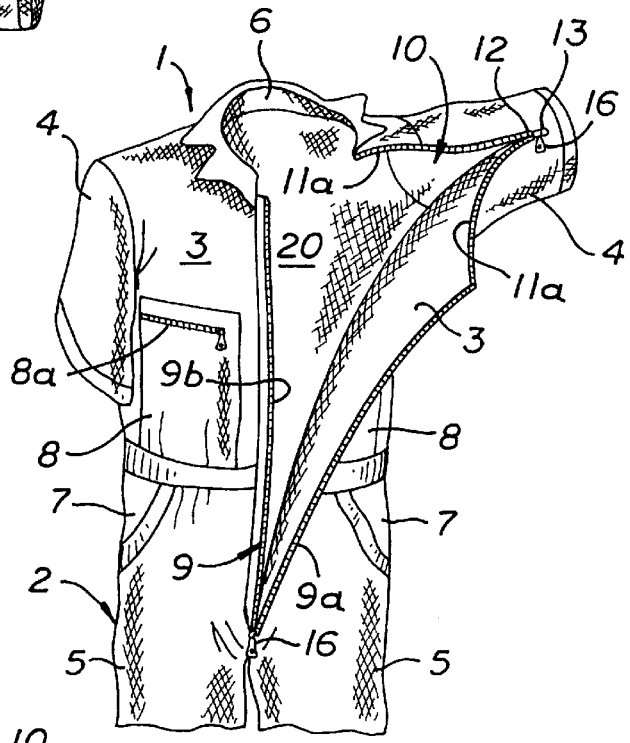
FIG. 2 is a front view of the coveralls illustrated in FIG. 1, with the front opening and access opening of the coveralls illustrated in open configuration.

Referring initially to FIGS. 1 and 2 of the drawings, in a preferred embodiment the coveralls with access opening of this invention are generally illustrated by reference numeral 1. The coveralls with access opening 1 are characterized by a standard or conventional pair of coveralls 2, typically constructed in conventional fashion from polyester, cotton or other fabric. The coveralls 2 are typically constructed by sewing a front panel 3 to a rear panel 20. The front panel 3 and rear panel 20 have a pair of legs 5 and the coveralls 2 are further conventionally provided with a pair of sleeves 4 and are optionally fitted with side pockets 7 and front pockets 8, typically reversibly closed by means of respective pocket zippers 8*a*. The front panel 3 is conventionally divided by a vertical front opening 9 which extends from the collar 6 downwardly to the fly 21 of the coveralls 2, and is typically reversibly closed by means of a front opening zipper 9*a* and an operating zipper pull 16, as illustrated in FIG. 2. A front opening flap 9*b* typically conceals the front opening zipper 9*a* from view when the front opening 9 is closed, as illustrated in FIG. 1. A left access opening 10 originates at the front opening 9 of the coveralls 2, below the collar 6 and extends substantially horizontally across the front panel 3 and the chest of a wearer (not illustrated) and then angles down the left sleeve 4 to an access sleeve end 13. In a preferred embodiment an access opening zipper 12, having an operating zipper pull 16, is provided along the access opening edges 11*a* of the left access opening 10 to facilitate reversibly closing the left access opening 10.

Figure 4:
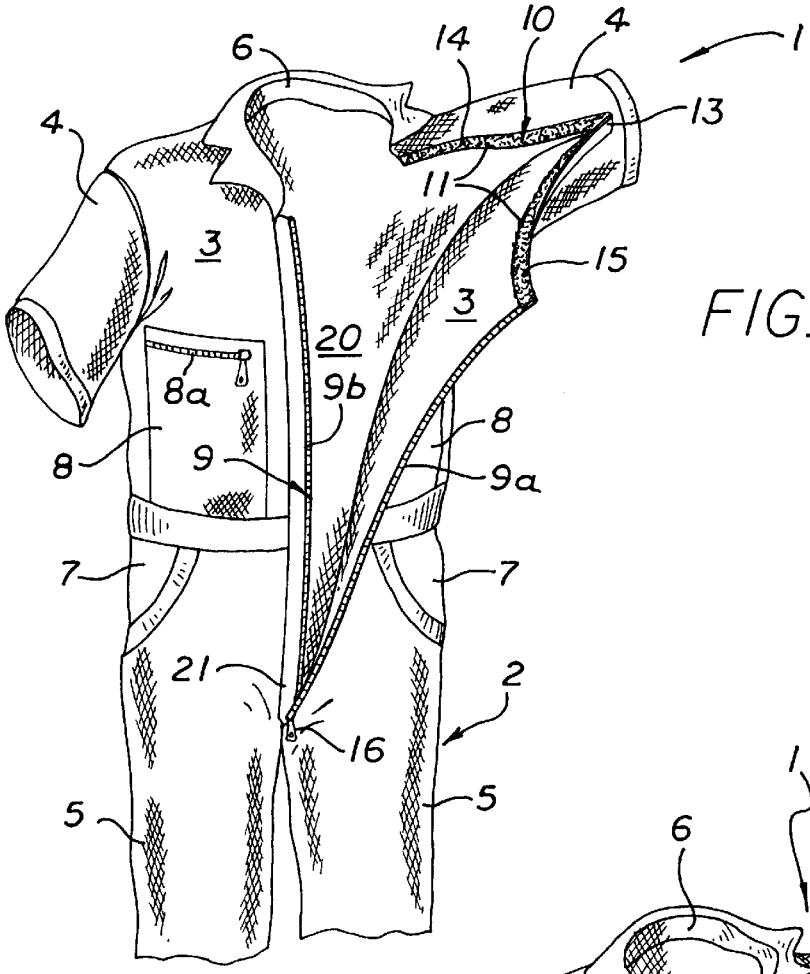
FIG. 4 is a front view of a loop-pile closure embodiment of the coveralls with access opening of this invention, with the front opening and access opening illustrated in open configuration.

In another embodiment illustrated in FIG. 4, a loop element strip 14 of a loop-pile fastener is provided along one access opening edge 11*a* of the left access opening 10 for removably engaging a pile element strip 15 of the loop pile fastener provided along the opposite access opening edge 11*a* of the left access opening 10, for reversibly closing the left access opening 10.

Figure 5:
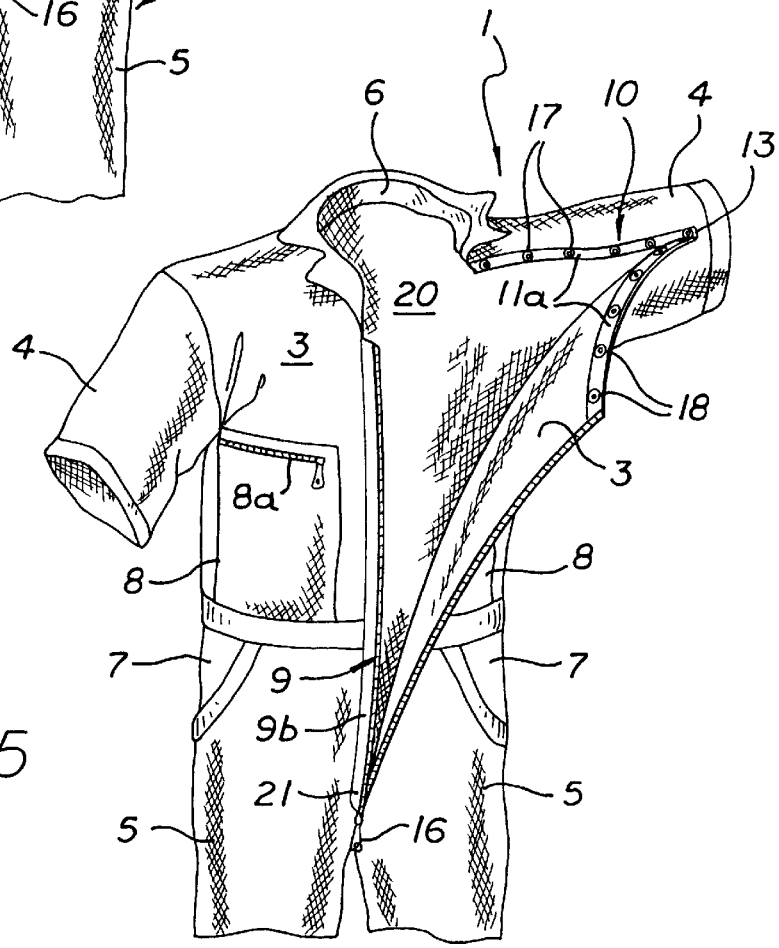
FIG. 5 is a front view, partially in section, of a snap or button closure embodiment of the coveralls with access opening of this invention, with the front opening and access opening illustrated in open configuration.

In still another embodiment illustrated in FIG. 5, male buttons or snaps 17, provided along one access opening edge 11*a* of the left access opening 10, are removably inserted into respective buttonholes or female snaps 18, provided along the opposite access opening edge 11*a* for reversibly closing the left access opening 10.

Figure 3:
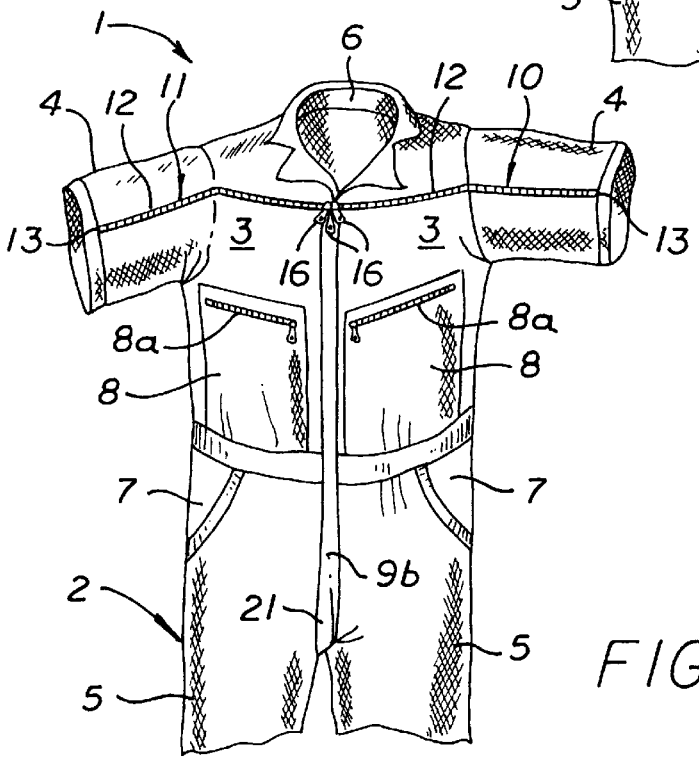
FIG. 3 is a front view of a dual access opening embodiment of the coveralls.

And in yet another embodiment illustrated in FIG. 3, a right access opening 11 originates at the front opening 9 of the coveralls 2, beneath the collar 6 and extends across the front panel 3 and the chest of a wearer, down the right sleeve 4 of the coveralls 3. An access opening zipper 12 is provided on the access opening edges 11*a* of the right access opening 11 and is opened and closed by an operating zipper pull 16, as described above with respect to the left access opening 10. Opening and closing of the right access opening 11, in combination with the left access opening 10, provides additional ease in ingress and egress of the coveralls 2, as hereinafter further described.

Referring next to FIGS. 2 and 4 of the drawing, to wear the coveralls with access opening 1, a wearer (not illustrated) of the coveralls 2 initially opens the typically vertical front opening 9 in conventional fashion, by manipulating the zipper pull 16 and unzipping the front opening zipper 9*a* from the collar 6 to the fly 21. The left access opening 10, or both the left access opening 10 and right access opening 11 of the embodiment illustrated in FIG. 3, are then opened by grasping the respective zipper pulls 16 and unzipping the access opening zipper or zippers 12, as illustrated in FIG. 2, or removing the loop element strip 14 from the pile element strip 15 of the loop-pile fastener, as illustrated in FIG. 4, or disengaging the buttons or male snaps 17 from the respective buttonholes or female snaps 18, as illustrated in FIG. 5. The wearer then steps into the respective legs 5 and easily extends his or her arms through the respective sleeves 4 of the coveralls 2. The front opening 9, left access opening 10 and/or right access opening 11 are finally closed in conventional fashion by first manipulating the corresponding zipper pull 16 upwardly, thus closing the front opening zipper 9*a* from the fly 21 to the collar 6. The appropriate zipper pull 16 is then grasped and the corresponding access opening zipper 12 is closed from the access sleeve end 13 to the front opening flap 9*b*. Alternatively, the loop element strip 14 may be engaged with the pile element strip 15 of the loop-pile fastener or buttons or male snaps 17 engaged with the respective buttonholes or female snaps 18. Accordingly, egress of the coveralls 2 is facilitated by opening the left access opening 10 or left access opening 10 and right access opening 11 and front opening 9, removing the arms from the respective sleeves 4 and then stepping from the legs 5 of the coveralls 2.

It will be appreciated by those skilled in the art that the left access opening 10 or right access opening 11 may be used either alone or in combination with the other, in order to facilitate greater ease in putting on and removing the coveralls 2. Furthermore, any desired fastening or closing mechanism, including buttons, snaps, loop-pile fasteners, or the like may be used instead of the front opening zipper 9*a* and access opening zipper 12, according to the knowledge of those skilled in the art, to facilitate reversible closing of the front opening 9, the left access opening 10 and/or the right access opening 11.

It will be further appreciated that the coveralls which incorporate the access openings of this invention can be of any desired design and may include "jump suits" and coveralls used by mechanics, medical personnel, workmen of all description, military personnel, fireman, law enforcement personnel and other, in non-exclusive particular.

While the preferred embodiments of the invention have been described above, it will be recognized and understood that various modifications may be made in the invention and the appended claims are intended to cover all such modifications which may fall within the scope and spirit of the invention.

Having described my invention with the particularity set forth above, what is claimed is:

1. Coveralls comprising a one-piece garment; a front panel provided in said garment; sleeves extending from said front panel; a front opening substantially vertically dividing said front panel; front opening closure means provided on said front panel at said front opening for selectively closing said front opening; a single access opening provided in said front panel, said access opening extending from said front opening through only one of said sleeves and said access opening communicating with said front opening; and access opening closure means provided on said front panel and said one of said sleeves at said access opening for reversibly closing said access opening, whereby ingress and egress of said coveralls is facilitated responsive to opening of said front opening closure means and said access opening closure means.

2. The coveralls of claim 1 wherein said front opening closure means comprises front opening closures selected from the group consisting of zippers, snaps, buttons and loop-pile fasteners.

3. The coveralls of claim 1 wherein said access opening closure means comprises closures selected from the group consisting of zippers, snaps, buttons and loop-pile fasteners.

4. The coveralls of claim 1 wherein:

(a) said front opening closure means comprises front opening closures selected from the group consisting of zippers, snaps, buttons and loop-pile fasteners; and (b) said access opening closure means comprises closure selected from the group consisting of zippers, snaps, buttons and loop-pile fasteners.

* * * * *